US006719483B1

(12) United States Patent
Welandsson

(10) Patent No.: US 6,719,483 B1
(45) Date of Patent: Apr. 13, 2004

(54) COLLISION SAFETY DEVICE

(76) Inventor: Anders Welandsson, Fållinge, Lillegård, SE-333 91 Smålandsstenar (SE)

( * ) Notice: Subject to any disclaimer, the term of this patent is extended or adjusted under 35 U.S.C. 154(b) by 0 days.

(21) Appl. No.: 09/856,756

(22) PCT Filed: Oct. 1, 1999

(86) PCT No.: PCT/SE99/01756

§ 371 (c)(1),
(2), (4) Date: May 23, 2001

(87) PCT Pub. No.: WO00/32878

PCT Pub. Date: Jun. 8, 2000

(30) Foreign Application Priority Data

Nov. 27, 1998 (SE) ..... 9804096

(51) Int. Cl.[7] ..... E01F 15/00
(52) U.S. Cl. ..... 404/6; 404/9; 256/13.1
(58) Field of Search ..... 404/6, 9; 256/13.1; 340/908.1

(56) References Cited

U.S. PATENT DOCUMENTS 4,655,434 A 4/1987 Bronstad
4,678,166 A 7/1987 Bronstad et al.
5,022,782 A 6/1991 Gertz et al.
5,078,366 A * 1/1992 Sicking et al. ..... 188/377
5,192,157 A * 3/1993 Laturner ..... 256/13.1
5,348,416 A 9/1994 Ivey et al.
5,391,016 A 2/1995 Ivey et al.
5,797,591 A * 8/1998 Krage ..... 256/1
5,851,005 A * 12/1998 Muller et al. ..... 256/13.1
5,967,497 A * 10/1999 Denman et al. ..... 256/13.1
6,022,003 A * 2/2000 Sicking et al. ..... 256/13.1
6,129,342 A * 10/2000 Bronstad ..... 256/13.1
6,220,575 B1 * 4/2001 Lindsay et al. ..... 256/13.1
6,293,727 B1 * 9/2001 Albritton ..... 256/13.1
6,299,141 B1 * 10/2001 Lindsay et al. ..... 256/13.1
6,554,256 B2 * 4/2003 Ochoa ..... 256/13.1

* cited by examiner

*Primary Examiner*—Robert E. Pezzuto
*Assistant Examiner*—Raymond W Addie
(74) *Attorney, Agent, or Firm*—Bachman & LaPointe, P.C.

(57) ABSTRACT

A collision safety device at an end section of a crash barrier (2) which includes at least one crash barrier girder (3, 4; 28) or profile. The crash barrier girder (3, 4; 28) extends along the ground a distance above it. In the region of the end section of the crash barrier (2), there is a safety member (6) which is disposed to be hit by a colliding vehicle and, under the action thereof, be displaced along the crash barrier (2). The safety member (6) has a forming device (7) which engages with the crash barrier girder (3, 4). When the safety member (6) moves along the crash barrier (2), a configurational change of the crash barrier girder (3, 4, 28) is realized. The forming device (7) has an entry end (8) in line with the undeformed crash barrier girder (3, 4; 28) and an exit end on a lower level in order that the deformed crash barrier girder will be capable of being driven over by the colliding vehicle.

18 Claims, 7 Drawing Sheets

COLLISION SAFETY DEVICE

TECHNICAL FIELD

The present invention relates to a collision safety device at an end section of a crash barrier and comprising at least one crash barrier girder or profile extending a distance above and approximately along the ground, a safety member in the area of the end portion of the crash barrier, the safety member being disposed to be hit by a colliding vehicle, and, under the action thereof, to be displaced along the crash barrier, the safety member having a forming device engaging with the crash barrier girder for realising an energy-absorbing configurational change in the crash barrier girder on the displacement of the safety member along the crash barrier.

The present invention also relates to a method of preventing or reducing damage to a vehicle and injuries to its passengers if the vehicle collides with an end section of a crash barrier, and comprises the steps that a crash barrier girder or profile included in the crash barrier is provided with a forming device, which, under the action of the colliding vehicle, is displaced along the crash barrier, the crash barrier girder being reshaped or bent while absorbing energy from the colliding vehicle.

BACKGROUND ART

Crash barriers occur in a multiplicity of different variations and are used to restrain a vehicle which, for some reason, has deviated from its course. The crash barriers consist of a barrier girder or profile which is supported by posts extending roughly parallel along the ground and a slight distance above it. There are variations in which several barrier girders or profiles are employed superposed over one another, but also variations in which a single narrow and tall profile is employed. Variations in which taut wire rope is employed instead of crash barrier girders or profiles also occur.

Regardless of how the crash barrier is constructed, the end of a crash barrier is a critical area, since it may constitute an accident hazard in the event of a vehicle colliding with the end of the barrier. There are various solutions in existence as regards eliminating these risk factors as far as is possible.

A common variation entails that a single and relatively tall crash barrier profile gradually tapers towards the ground in order to terminate below ground level. Such a termination of a crash barrier entails that the vehicle avoids being stopped dead, but instead the vehicle is gradually lifted up by the crash barrier termination as the vehicle rides along it. An overturning vehicle may easily be the result. In addition, the installation of such a termination section to a crash barrier requires extensive excavation work There are also variations in which a protection member or impact retardation member is placed at the end of a crash barrier facing towards the traffic, the crash barrier having a tall, narrow upright barrier profile which is approximately W-shaped in cross section, the protection member or retardation member having a considerably larger surface area facing towards a colliding vehicle than the cross-sectional area of the barrier profile included in the crash barrier, the protection or retardation member being intended to be hit by a colliding vehicle. The posts which, most proximal the retardation member, support the crash barrier profile are manufactured of wood and have lines of weakness so that they give way in a controlled manner in the event of a collision against the crash barrier. The retardation member is disposed at the end of an assembly which faces towards the traffic and which, on collision, is intended to be displaced along the crash barrier profile. This assembly includes a reforming device which, on displacement of the assembly along the crash barrier profile, first flattens out the profile so that this assumes a form which at least approximates the form of a sheet metal strip standing on end. The reforming device further includes a bending device which, after flattening of the profile horizontally, bends out the flattened profile in the lateral direction when the assembly with the retardation member is displaced along the crash barrier.

In certain cases, the above-described constructions may function well, but cannot be employed between closely adjacent traffic lanes, since the flattened profile is projected out laterally into one of the traffic lanes, where, naturally, it constitutes a dangerous obstacle.

The prior art constructions further suffer from drawbacks in the form of complicated and expensive assembly (with extensive excavation work), and other accident hazard risks, etc.

PROBLEM STRUCTURE

The present invention has for its object to design the collision safety device and the method of preventing or reducing damage to a vehicle and injuries to its passengers disclosed by way of introduction such that the drawbacks inherent in prior art technology are thereby obviated. In particular, the present invention has for its object to design the collision safety device in such a manner that it will be simple and economical to assemble and, as far as possible, eliminates accident risks and provides a gentle deceleration of a colliding vehicle. Finally, the present invention has for its object to design the collision safety device in such a manner that it may also be employed between closely adjacent traffic lanes with complete protective effect.

SOLUTION

The objects forming the basis of the present invention will be attained in respect of the collision safety device if this is characterized in that the forming device has an entry end in line with the undeformed crash barrier girder and an exit end at a lower level in order that the deformed crash barrier girder can be driven over by the colliding vehicle.

In one preferred embodiment of the collision safety device according to the present invention, it also suitably applies that the free end of the crash barrier girder is connected to a tension or drawing device such a wire rope, chain or drawbar, the drawing device extending substantially in the longitudinal direction of the crash barrier to the side of the safety member facing away from the crash barrier where it is anchored in an anchorage device secured in the ground.

The objects forming the basis of the present invention will be attained in respect of the method if this is characterized in that the crash barrier girder is curved obliquely downwards towards the ground, that it is placed at a height level to be able to be driven over by the colliding vehicle, and that its longitudinal direction is kept substantially unchanged compared with the original longitudinal direction of the crash barrier.

BRIEF DESCRIPTION OF THE ACCOMPANYING DRAWINGS

The present invention will now be described in greater detail hereinbelow, with reference to the accompanying Drawings. In the accompanying Drawings.

Figure 3:
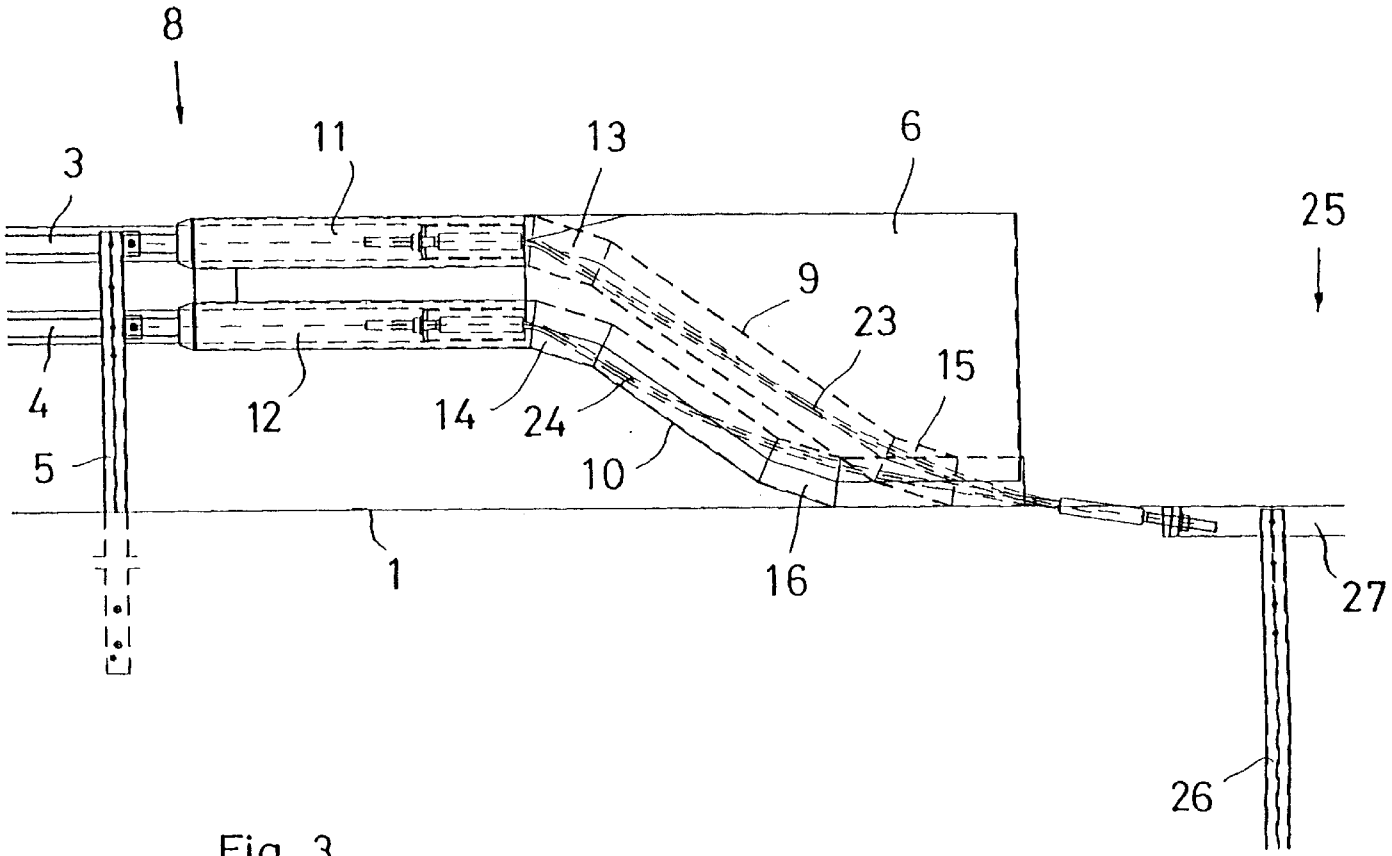
FIG. 3 is a detailed view from FIG. 2.
Figure 6:
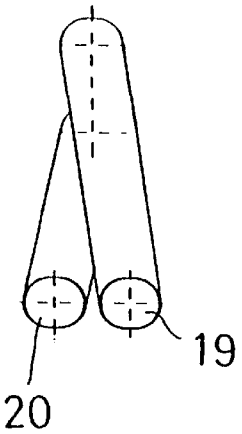
FIG. 6 shows the forming device according to FIG. 4, seen in a direction from the right in FIGS. 4 and 5.
Figure 7:
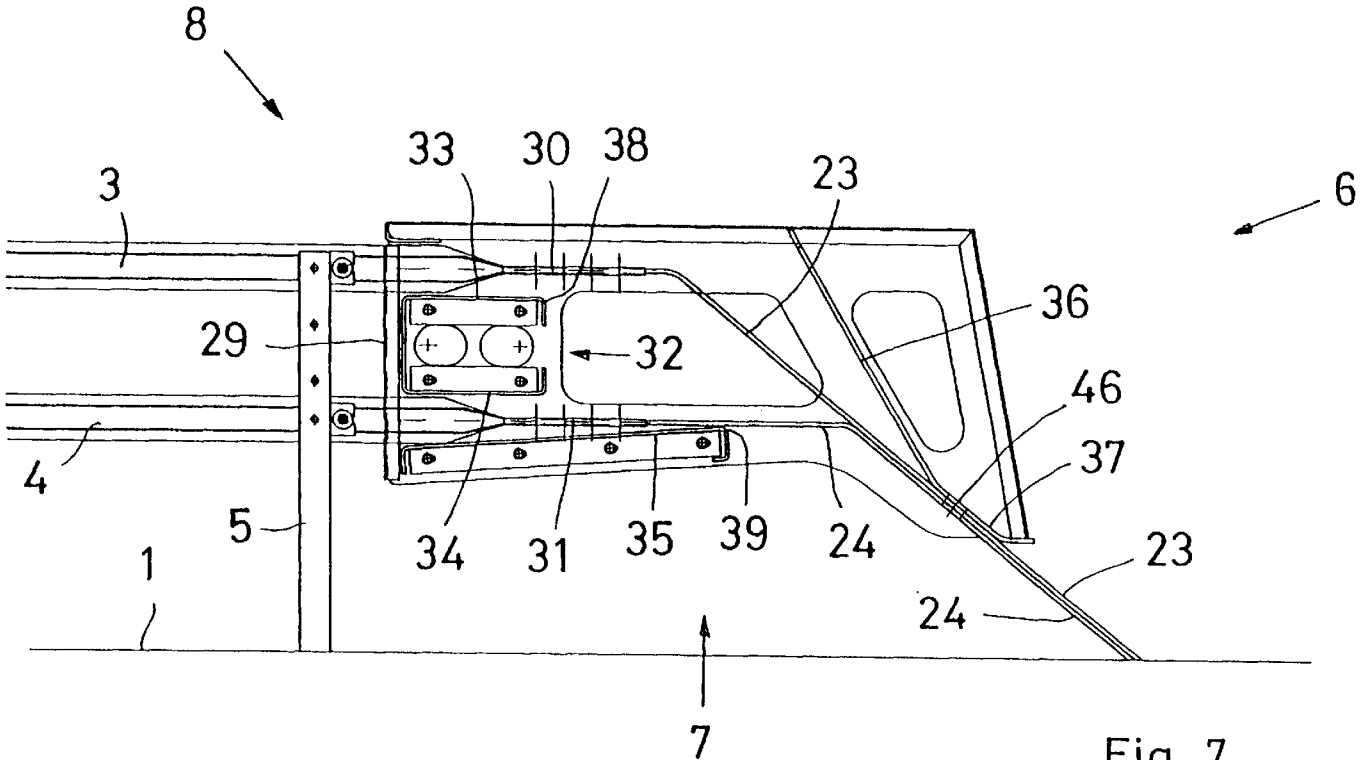
FIG. 7 is a view corresponding to that of FIG. 3 of a first alternative embodiment of the present invention.
Figure 8:
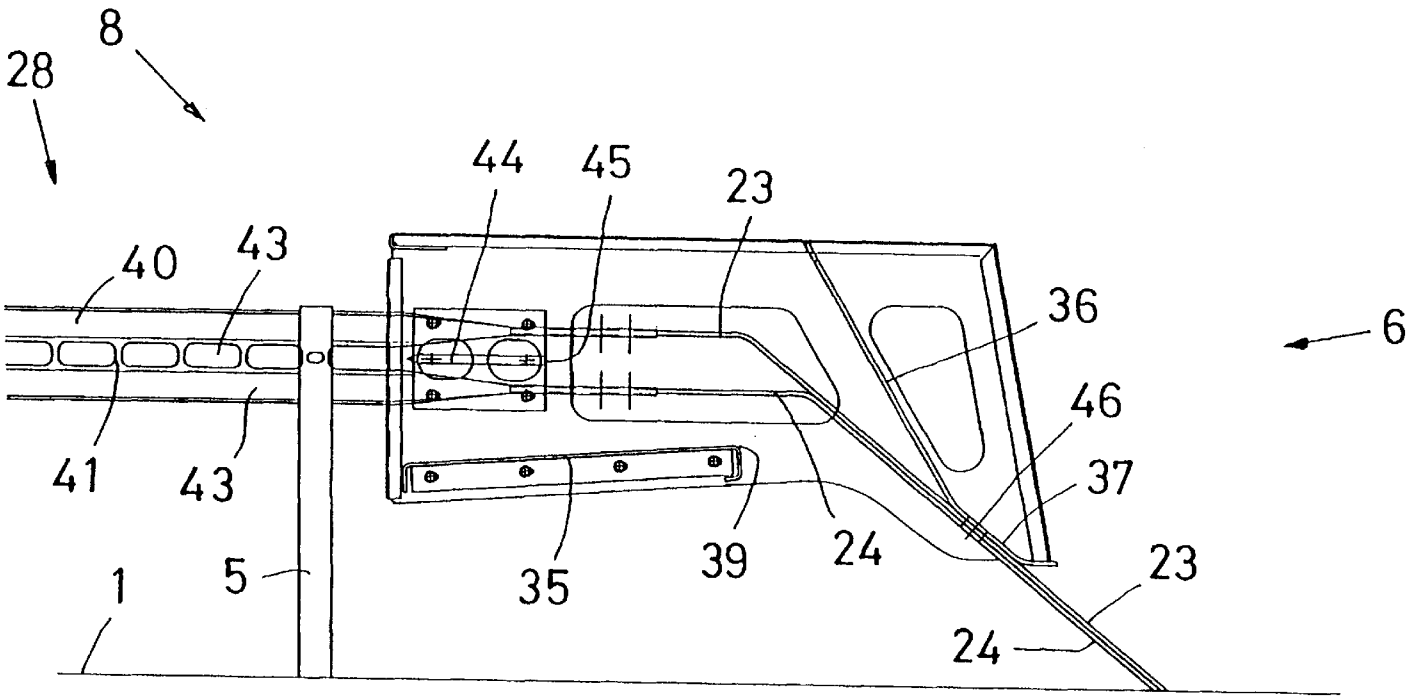
FIG. 8 is a view corresponding to FIG. 3 of a second alternative embodiment of the present invention.
Figure 9:
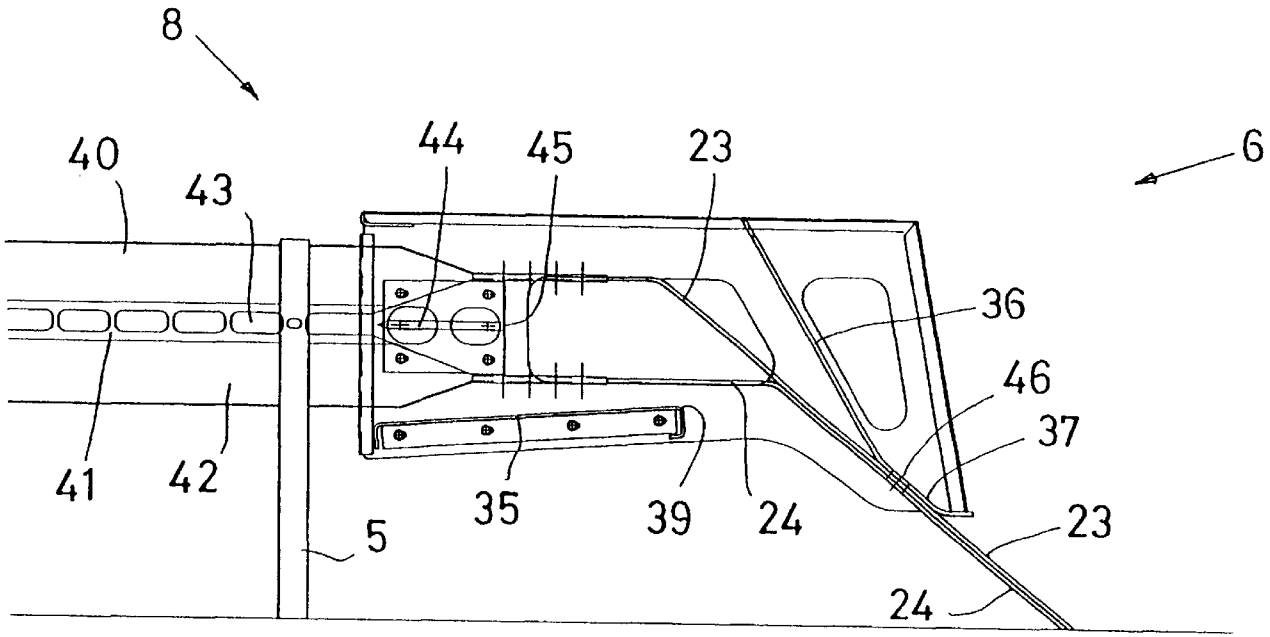
Figure 12:
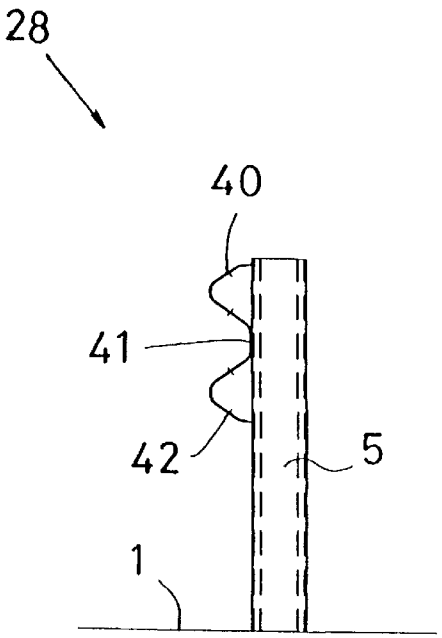
Figure 11:
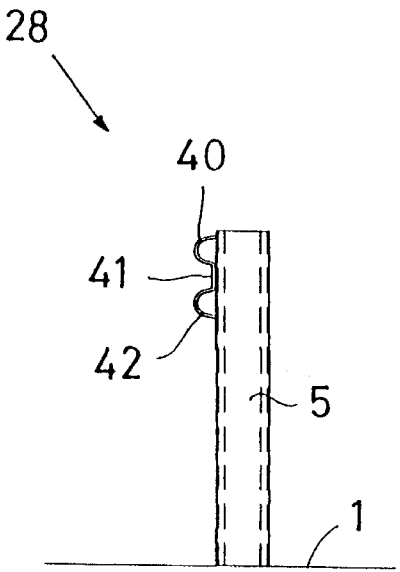
Figure 10:
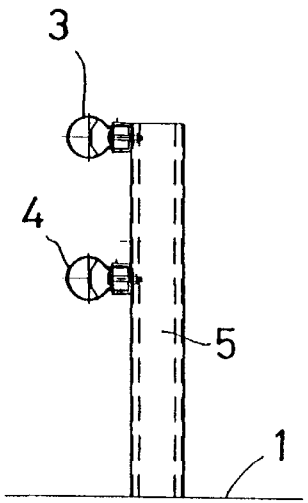

FIG. 9 is a view corresponding to FIG. 3 of a third alternative embodiment of the present invention; and FIGS. 10–12 are end elevations of differently designed crash barrier girders, where the crash barrier girders according to FIG. 10 come into use in the embodiments according to FIGS. 1–7, the crash barrier girder according to FIG. 11 comes into use in the embodiment according to FIG. 8, while the crash barrier girder according to FIG. 12 is used in the embodiment according to FIG. 9.

DESCRIPTION OF PREFERRED EMBODIMENT

Figure 1:
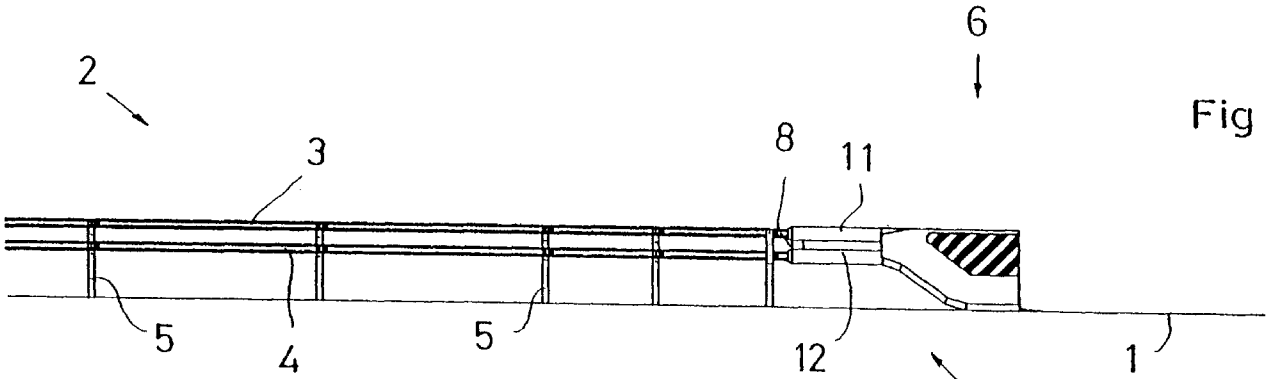
FIG. 1 is a side elevation of a crash barrier with a collision safety device according to the present invention.
Figure 2:
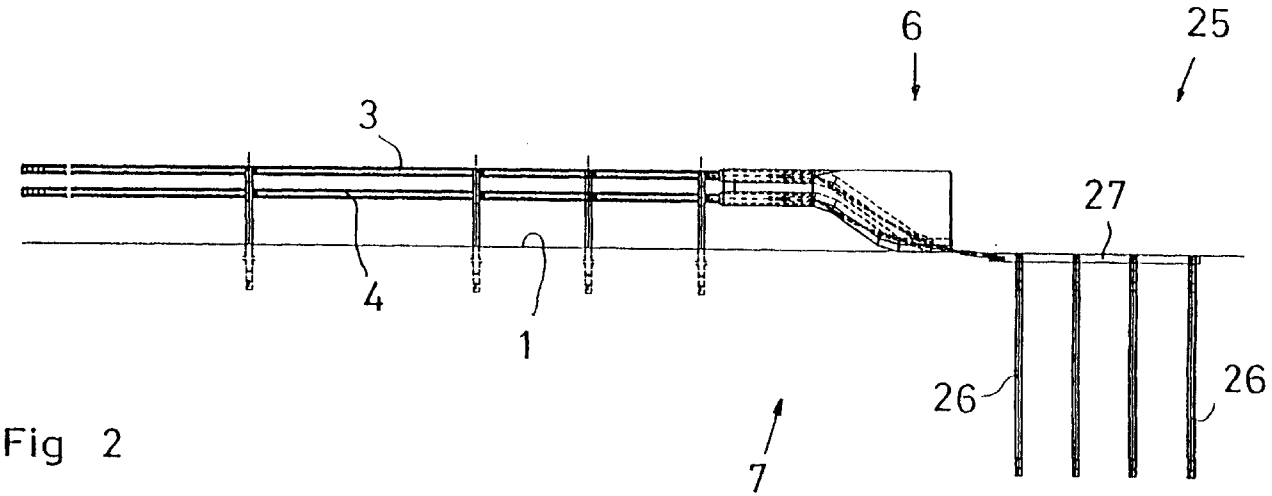
FIG. 2 is a view corresponding to FIG. 1, parts located underground being also shown.

In FIG. 1, reference numeral 1 relates to a ground surface along which extends a crash barrier 2 which has two mutually superposed crash barrier girders or profiles 3 and 4 respectively. The two crash barrier girders 3 and 4 are supported by a number of posts 5 anchored in the ground 1. In alternative embodiments, the crash barrier 2 may also have a single tall, narrow crash barrier profile standing on its end, for example a so-called Kohlsva profile or a so-called W-profile.

The crash barrier girders may also have other cross-sectional configurations, such as elliptical, rectangular, square, etc. The only crucial feature according to the present invention is that the crash barrier girders or girder may initially have or subsequently be given a flexural resistance about horizontal flexural axes transversely directed in relation to the longitudinal direction of the crash barrier girder, this resistance being capable of being overcome and being of the same order of magnitude as the flexural resistance of the tube profile described by way of introduction. On the other hand, there is nothing to prevent the employment of a plurality of crash barrier girders at different height levels as long as the individual crash barrier girder satisfies the above criteria.

In the right-hand end in the Figures, the crash barrier 2, which has two identical mutually superposed crash barrier girders 3 and 4, has an end with a collision safety device which is intended to be hit by a colliding vehicle (driving in a direction to the left in FIGS. 1 and 2) so that the vehicle does not hit the end proper of the crash barrier.

The collision safety device includes a safety member 6 which is intended to be hit directly by the colliding vehicle. The safety member has a lower section which rests on the ground 1 and is shiftably disposed along the ground and in the longitudinal direction of the crash barrier 2 so that a colliding vehicle shunts the safety member ahead of it instead of directly impacting against the end of the crash barrier. The safety member 6 further cooperates with guide means which prevent the safety member from being appreciably lifted or moved sideways in relation to the longitudinal direction of the crash barrier f2. The safety member 6 is further designed to have a maximum configurational stability in relation to the mass which should be slight in relation to the mass of a colliding vehicle. At an estimation, the safety member 6 may have a mass of the order of magnitude of 100–200 kg, i.e. less than 10–15 percent of the mass of an average private car.

The safety member 6 includes a forming device 7 which cooperates with the crash barrier girders 3 and 4 in order to achieve an energy-absorbing configurational change in them when the safety member 6 and the forming device are shunted ahead of a colliding vehicle along the crash barrier. The forming device has an entry end 8 on a level with each one of the crash barrier girders 3 and 4 and corresponding exit ends, both on the level of the ground 2 or slightly above it. The exact height is immaterial as long as it is sufficiently slight to permit a colliding vehicle to pass over the deformed crash barrier girders. The exit ends are directed substantially in the longitudinal direction of the crash barrier.

On displacement of the safety member 6 with the forming device 7 along the crash barrier, the forming device realises a downward bending of the crash barrier girders 3 and 4 from the normal, undeformed level to a lower level along the ground, the level of the deformed crash barrier girder or girders being such that these can be driven over by a vehicle without any appreciable risk of hitting it or being caught in it. Ideally, they lie flat along the ground. It is also essential that they are prevented from bending out sideways so that, even in the deformed state, they have approximately the same longitudinal direction as the rest of the crash barrier. The energy which is consumed for the configurational change to the crash barrier girders 3 and 4 derives from the kinetic energy of the colliding vehicle, whereby this is decelerated or retarded. With suitable dimensioning of both the safety member 6, the forming device 7 and of the crash barrier girders 3 and 4, retardation distances of as much as up to 10-odd metres may be achieved. In such instance, it is presupposed that the unions between the posts 5 and the crash barrier girders 3 and 4 are designed either so that they can be shifted along the crash barrier girders 3 and 4 or so that they break when they come into contact with the forming device 7.

It will be apparent from FIG. 3 that the safety member 6 is in the form of an enclosure or box which is manufactured from sheet metal and in which the forming device 7 with curved channels 9 and 10 is housed. The channels 9 and 10 are designed to be able to accommodate the crash barrier girders 3 and 4. The upper ends of the channels 9 and 10 are connected to substantially straight tubular sections 11 and 12, respectively, in which the end portions of the crash barrier girders 3 and 4, respectively, are located before a collision. The straight tube sections 11 and 12 may be considered as being included in the above-mentioned guide means. In association with the right-hand ends of the tube sections 11 and 12 in FIG. 3, there are provided upper curved sections 13 and 14, respectively, of the two channels 9 and 10, respectively. These curved sections are designed so as to curve or bend the crash barrier girders 3 and 4 in a direction obliquely downwards towards the ground level when the unit of the safety member 6 and the forming device 7 is displaced in a direction to the left in FIGS. 1–3, i.e. when the unit is displaced along the crash barrier in a direction to the left as a consequence of a collision. In their central regions, the channels 9 and 10 have straight portions, but, at their lower ends, they have lower curved sections 15 and 16, respectively, via which the crash barrier girders 3 and 4 are bent down to positions approximately parallel with the ground before leaving the unit consisting of the safety member and the forming device when this is moved to the left. After the passage of the unit consisting of the safety member and the forming device to the left, the twice deformed—or reformed—crash barrier girders 3 and 4 lie more or less straight and at ground level.

Figure 4:
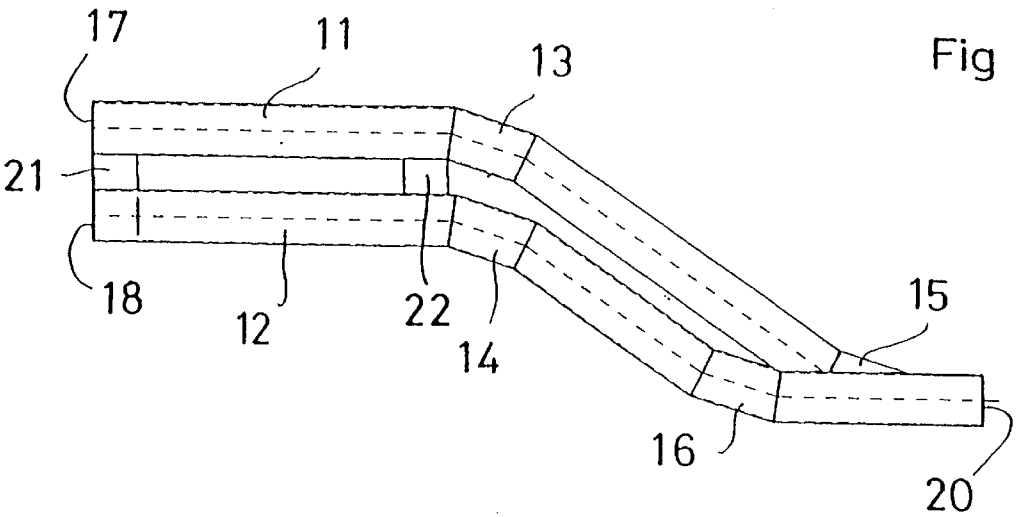
FIG. 4 is a side elevation of a forming device included in the subject matter of the present invention.
Figure 5:
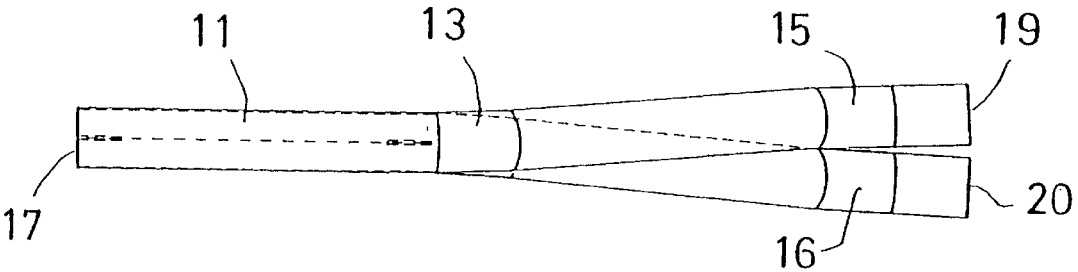
FIG. 5 is a top plan view of the forming device according to FIG. 4.

FIGS. 4–6 show more clearly the formation of the channels 9 and 10, it being apparent that the two channels have their entry openings 17 and 18, respectively, placed over one another and that the exit openings 19 and 20, respectively, are side-by-side at ground level. It will be apparent from FIG. 5 that the exit openings diverge somewhat. This is in itself not the intention, since they should be substantially parallel with one another, but is of no major disadvantage as long as the divergence is slight. Possibly, the channels 9 and 10 may also be horizontally curved so that their exit ends are parallel or at least diverge only slightly.

It will further be apparent from FIG. 4 that the tube units which consists of the channels 9 and 10 and the tube sections 11 and 12 are interconnected with one another via connecting pieces 21 and 22. They are also united with each other at the lower ends, i.e. in the region of the exit openings 19 and 20. The channels and tube sections therefore form a configuration ally stable unit which, on its displacement along the crash barrier girders 3 and 4, remains largely undeformed and instead bends the crash barrier girders. Further, the union between the safety member 6 and the channels 9 and 10 is so powerful that no appreciable relative movements between these components occurs on collision, nor does any appreciable deformation take place of the unit as a whole.

In the foregoing, the channels 9 and 10 were described as tubular. According to the present invention, this is not necessary. Thus, the channels may be defined by a system of rods or tubes, both transversely and longitudinally, but also by gutter or cup-shaped guide rails which realise the sought-for forming of the crash barrier girders 3 and 4.

In order, also in the event of oblique collisions, to ensure the above-described function, the free ends of the crash barrier girders 3 and 4 are connected to drawing members 23 and 24, respectively. The drawing members, which are included in the above-mentioned guide means, are designed so as to prevent lifting and movement of the safety member 6 transversally of the longitudinal direction of the crash barrier 2. The drawing members 23 and 24 are designed as wire ropes, chains, flat profiles or the like. In the side of the safety member 6 facing away from the crash barrier 2, the drawing members are connected to an anchorage device 25 anchored in the ground. The anchorage device 25 is located on or below ground level and, as a result, constitutes no hazard for a colliding vehicle. As a result of the presence of the drawing members 23 and 24 and the anchorage device 25, the safety member 6 and the crash barrier girders 3 and 4 are prevented from being displaced sideways in the event of an oblique collision. The anchorage device 25 and its placing close to the safety member 6 also entail an obstacle to lifting of the safety member.

The anchorage device 25 and the two drawing members 23 and 24 secured in the crash barrier girders 3 and 4 also fulfill the vital function of preventing the crash barrier girders 3 and 4 from being buckled and broken ahead of the forming device 7 instead of passing through it. The drawing members thereby ensure that the deformation of the crash barrier girders 3 and 4 takes place under tractive loading on them and not under compressive loading, which in all likelihood would result in the above-mentioned outward buckling.

The anchorage device 25 has a number of anchorage rods or tubes 26 which are driven into the ground and which, at their upper ends, are united via one or more horizontal struts 27 which lie in or below ground level 1. How long the horizontal struts need to be, and how many anchorage rods 26 driven into the ground need to be may vary, but depends upon the terrain conditions. However, the concept is that the anchorage device is to remain stationary in the ground without being moved or deformed to any appreciable degree even in the event of extremely violent collisions. Furthermore, the drawing members 23 and 24 per se, but also their connections to the crash barrier girders 3 and 4 are designed to withstand extremely high tractive loadings so that thereby the crash barrier girders 3 and 4 are held reliably longitudinally fixed in relation to the anchorage device 25.

An adaptation of the retardation or deceleration which is obtained on displacement of the safety member 6 along the crash barrier 2 may be made by means of suitable selection of dimensions, profile configuration and material quality in the crash barrier girders 3 and 4. Correspondingly, the curvatures in the channels 9 and 10 will influence the deformation operation. In particular, it is possible, in addition to vertical curving, also to expose the crash barrier girders 3 and 4 to curving or bending in other directions, such as horizontal or about the longitudinal directions of the crash barrier girders.

In order to facilitate installation and adjustment of the subject matter of the present invention, the anchorages of the drawing members 23 and 24 may be adjusted and pre-tensioned, preferably in both ends.

DESCRIPTION OF ALTERNATIVE EMBODIMENTS

In the foregoing, the present invention has been described as applied to a crash barrier profile which is more or less rotation-symmetric as regards mechanical strength properties. In the alternative with an upright crash barrier profile which is approximately W-shaped in cross section (in practice having a height of 310 mm), it is not possible immediately to bend this down along the ground since, on the one hand, the flexural resistance is too great and, on the other hand, the height is so great that it will hardly have room under a normal private car.

In order to obviate this problem, in one modified embodiment of the present invention, the forming device 7 is designed in a different way than that described above. Thus, the forming device 7 includes a wedge or roller device by means of which the initially approximately W-shaped profile is flattened out, at least partly, so that it becomes wider (higher in the position of use in the crash barrier) and narrower, and thereby easier to bend.

The forming device 7 further has a torque device by means of which the wholly or partly flattened profile is twisted through approximately a quarter of a turn about its longitudinal axis so that the profile will have its largest extent (width) oriented approximately horizontally or approximately parallel with the ground 1.

Finally, the forming device 7 has a bending device which in principle corresponds to the above-described channel arrangement 9 and 10. The bending device is therefore designed so as to bend the profile obliquely down towards the ground 1 and then, when it is located approximately on or just above ground level, to straighten it out to a position along the ground so that it may pass under a colliding vehicle.

A further three alternative embodiments will be described below, and it should be observed that parts and details which were described in the foregoing also carry the same reference numerals in the alternative embodiments.

FIG. 7 shows one embodiment for application in a crash barrier with two mutually superposed crash barrier girders 3 and 4 of a cross-sectional configuration which was describe above and which is also shown in FIG. 10.

The most tangible difference between the embodiment according to FIG. 7 and that described in the foregoing is that the channel system which, in the above-described embodiment, was realised by the employment of different tube components, is now absent and instead has been replaced by forming surfaces in the forming device 7.

In the embodiment according to FIG. 7, the safety member 6 has an end plate 29 with an upper and lower aperture through which the two crash barrier girders 3 and 4, respectively, extend to the interior of the safety member 6. As is apparent from the Drawing, the crash barrier girders 3 and 4 are interior spiculated in the safety member, the spiculated regions being, via connecting portions 30 and 31, respectively, connected to the two drawing members 23 and 24 which, in this embodiment, are in the form of plate profiles. The connecting portions 30 and 31, as well as the spiculated regions of the crash barrier girders, are realised in that the crash barrier girders are provided with longitudinal slits and thereafter flattened. The connecting portions 30 and 31 are connected to the drawing members 23 and 24 by the intermediary of bolt unions which are dimensioned in such a manner that they do not run any risk of failing during a collision cycle.

As one alternative to the end plate 29, the safety member 6 may also be substantially open in its front end, i.e. in its end facing towards the crash barrier girders. In such an embodiment, the edges of the aperture are reinforced and as rigid as possible in that reinforcement is provided there which may be realised in that the material in the walls surrounding the aperture has been folded double along the aperture.

In the vertical direction counting between the two apertures in the end plate 29 through which the two crash barrier girders 3 and 4 extend to the interior of the safety member 6, there is disposed a guide member 32 with substantially parallel upper and lower sides 33 and 34, respectively. On the top of the upper side 33 of the guide member 32 and the lower side of the safety member 6, a space is formed for the upper crash barrier girder 3, the space being, in terms of function, likened to the space which is defined by the upper, straight tubular section 11 in FIG. 4. Correspondingly, beneath the bottom side 34 of the guide member 32 but above a lower wall 35 in the safety member 6, a space is formed which, in terms of function, may be likened to the straight, lower tubular section 12 in FIG. 4. Both the guide member 32 and the lower wall 35 are substantially configurationally stable and therefore powerfully dimensioned as well as secured in the safety member in a correspondingly stable manner.

In the embodiment where the front end of the safety member 6 is open and where the guide member 32 and the lower wall 35 are mounted by means of bolt unions in the safety member, the installation of this on the crash barrier profiles 3 and 4 and to the drawing members 23 and 24 will be extra simple in that the safety member is quite simply lifted in place and the guide member 32 and the lower wall 35 are placed in the correct position and bolted fast via openings in the sides and bottom of the safety member 6. The safety member is also, as will be described in greater detail below, secured in the two drawing members 23 and 24 by the intermediary of a weak bolt union.

The forming surfaces further include interiorly in the safety member 6 a rear, obliquely directed wall 36 which, with its upper region, is located more proximal the ends of the crash barrier girders than is the case for its lower region. The angle between the obliquely directed wall and the vertical plane may amount to the order of magnitude of 30°. At the lower end of the obliquely directed wall, this has a curved portion 37 which makes an angle with a vertical plane of the order of magnitude of 45°. Both the obliquely directed wall 36 and its lower, curved portion 37 are powerfully dimensioned in order to be substantially configurationally stable and are secured in the safety member 6 in a corresponding manner.

It will further be apparent from the Figure that the upper drawing member 23 is curved obliquely downwards towards the ground 1 and extends approximately along a straight line to the ground and is tangential to the lower curved portion 37 of the obliquely directed wall. The lower drawing member 24 has, as an extension of the lower connecting portion 31, a substantially straight and horizontal portion which, via a curve, connects to a lower portion which extends along the lower side of the upper drawing member 23. In the region of the curved portion 37 of the obliquely inclined wall, the two drawing members and the curved portion are united via a weakly dimensioned bolt union 46 in such a manner that the union is intended to break on collision with the safety member 6. As a result, no support of the safety member 6 against the ground is necessary.

On collision with the safety member 6, the two drawing members will be straightened out and the bolt union 46 will break. For the upper drawing member 23, this implies that as soon as the safety member 6 has passed so far in a direction to the left that an upper corner portion 38 of the guide member 32 will come into abutment against the upper crash barrier profile 3 proper, the crash barrier profile will be buckled obliquely downwards over the corner portion 38.

Correspondingly, the lower crash barrier girder 4 will be buckled obliquely downwards as soon as it has arrived at the right-hand end portion in the Figure of the lower end wall 35.

The above-described bending downwards of the two crash barrier girders 3 and 4 continues as long as the crash barrier girders come into contact with the lower, curved portion 37 of the obliquely directed wall 36. Because of the tractive force which is exercised by the drawing members 23 and 24, the two crash barrier girders will be bent around the curved portion 37 so that they are directed more horizontally along the ground. Since the drawing members 23 and 24 are anchored in the ground in or beneath ground level, the two deformed crash barrier girders 3 and 4 will arrive at such a low level along the ground that they may be driven over by a vehicle substantially without risk.

In the embodiment according to FIG. 8, the two separate crash barrier girders 3 and 4 have been superseded by a single crash barrier girder 28 which is tall and narrow in cross section. The cross-sectional configuration of the crash barrier girder 28 illustrated in FIG. 8 is apparent from FIG. 11. Such a crash barrier girder is of the so-called Kohlsva type and has an upper part-profile 40 which is approximately U-shaped in cross section and an approximately vertical web 41 and a lower part-profile 42 which is approximately U-shaped in cross section.

As will be apparent from FIG. 8, the web of the crash barrier profile 28 has been provided with a number of through-going apertures 43 which together form a longitudinal indication of fracture. In line with this indication of fracture, there is placed, interiorly in the safety member 6 and at its entry end 8, a separator device 44 which is designed as a horizontal knife. The knife 44 is secured on mounting plates which are placed at the same position as the guide member 32 in the embodiment according to FIG. 7. The knife and its mounting plates are also substantially configurationally stable and secured in the safety member 6 in a correspondingly satisfactory manner.

The two part-profiles 40 and 42 included in the tall and narrow profile 28 are spiculated in approximately the same manner as was described with reference to FIG. 7 and are connected to the drawing members 23 and 24, respectively, in a manner which is fully analogous with that described above. Further, the drawing members extend in the same manner as that described above.

On collision with the safety member 6, the two drawing members 23 and 24 are stretched, at the same time as the knife 44 moves along the longitudinal indication of fracture, i.e. it breaks the bridge shaped portions which, between the apertures 43, remain of the web 41 of the profile so that thereby the part-profiles 40 and 42 will be free. These will thereafter be deformed in a manner which is totally analogous with that described with reference to FIG. 7, apart from the fact that the upper part-profile 40 is buckled around the rear end 45 of the knife 44 before possibly coming into contact with the end portion 39 of the lower wall 35. Under any circumstances, the two part-profiles 40 and 42 are laid to a more horizontal position along the ground 1 by being bent about the curved portion 37 of the obliquely directed wall 36.

The embodiment according to FIG. 9 is totally analogous with the embodiment according to FIG. 8, apart from the fact, in this embodiment, the crash barrier profile 28 of tall and narrow cross section is a so-called W-profile. Analogous with that described above, the W-profile has an upper part-profile 40 a centrally located web 41 and a lower part-profile 42. Also in this embodiment, there is a series of apertures 43 provided in the web, and these form a longitudinal indication of fracture, at least along that length of the crash barrier profile which may come into question for decelerating and retarding a colliding vehicle.

What is claimed is:

1. A collision safety device at an end section of a crash barrier (2), and comprising at least one crash barrier girder (3, 4; 28) or profile extending approximately parallel to and above the ground at a first level, a safety member (6) in the area of the end portion of the crash barrier, the safety member being disposed to be hit by a colliding vehicle, and, under the action thereof, to be displaced along the crash barrier (2), the safety member having a forming device (7) engaging with the crash barrier girder (3, 4; 28) for realising an energy-absorbing configurational change in the crash barrier girder (3, 4; 28) on the displacement of the safety member along the crash barrier, characterized in that the forming device (7) has an entry end (8) at said first level of the undeformed crash barrier girder (3, 4; 28) and an exit end on a second level lower than said first level in order that the deformed crash barrier girder can be driven over by the colliding vehicle.

2. The collision safety device as claimed in claim 1, characterized in that the free end of the crash barrier girder (3, 4; 28) is connected to a drawing member (23, 24), wherein the drawing member is secured to the ground via an anchorage device (25) and extends in a longitudinal direction from the crash barrier (2) towards the safety member (6).

3. The collision safety device of claim 2, wherein said drawing member is selected from the group consisting of a wire rope, a chain, and a crowbar.

4. The collision safety device as claimed in claim 2, characterized in that the portion of the drawing member (23, 24) secured in the anchorage device (25) is located on or below ground level (1).

5. The collision safety device as claimed in claim 4, characterized in that the configurationally stable walls include a lower, substantially horizontal wall (35) which is located under the crash barrier girder (3, 4; 28) and which has an end (39) a distance from the entry end of the forming device (7), the crash barrier girder which, in its longitudinal direction, is positionally fixed by the drawing member (23, 24), being disposed to be bent obliquely downwards towards the ground at its end.

6. The collision safety device as claimed in claim 5, characterized in that the lower edge of the rear wall (36) is located on a lower level than the rear end (39) of the lower wall (35).

7. The collision safety device as claimed in claim 4, characterized in that the configurationally stable walls include a rear wall (36) which is located at the exit end of the forming device (7) and has a lower end (37) on a lower level than the crash barrier girder (3, 4; 28), the crash barrier girder which, in its longitudinal direction, is positionally fixed by the drawing member (23, 24), being disposed to be bent to a position with its longitudinal direction approximately along the ground.

8. The collision safety device as claimed in claim 1, characterized in that the forming device (7) has two entry ends (17, 18) placed for cooperation with two mutually superposed crash barrier girders (3, 4; 28) and two exit ends (19, 20) located side-by-side at ground level (1).

9. The collision safety device as claimed in claim 1, characterized in that the forming device (7) has an entry end of tall, narrow configuration for accommodating a crash barrier girder (3, 4; 28) of tall, narrow cross section, the crash barrier girder having, between an upper (40) and a lower (42) portion, a longitudinal fracture indication (43); and that in the region of the entry end, there is disposed a splitter device (44) which, when it, together with the forming device (7) is displaced along the crash barrier girder, is disposed to separate the upper and lower portions of the crash barrier girder from each other.

10. A collision safety device at an end section of a crash barrier (2), and comprising at least one crash barrier girder (3, 4; 28) or profile extending approximately parallel to and above the ground at a first level, a safety member (6) in the area of the end portion of the crash barrier, the safety member being disposed to be hit by a colliding vehicle, and, under the action thereof, to be displaced along the crash barrier (2), the safety member having a forming device (7) engaging with the crash barrier girder (3, 4; 28) for realising an energy-absorbing configurational change in the crash barrier girder (3, 4; 28) on the displacement of the safety member along the crash barrier, characterized in that the forming device (7) has an entry end (8) at said first level of the undeformed crash barrier girder (3, 4; 28) and an exit end on a second level than said first level in order that the deformed crash barrier girder can be driven over by the colliding vehicle, characterized in that the forming device (7) includes a number of configurationally stable walls or surfaces which, on displacement of the safety member (6) along the crash barrier, are disposed to deform the crash barrier girder (3, 4; 28), further characterized in that the forming device (7) has, at its entry end (8) a tube (11, 12) for accommodating the crash barrier girder (3, 4; 28), a first curved section (13, 14) for oblique downward curving of the crash barrier girder, and a second curved section (15, 16) for bending the crash barrier girder along the ground (1).

11. A method of preventing or reducing damage to a vehicle and injury to its passengers if the vehicle collides with an end section of a crash barrier (2), comprising the steps that a crash barrier girder or profile (3, 4; 28) included in the crash barrier is provided with a forming device (7) which, under the action of a colliding vehicle, is displaced along the crash barrier, the crash barrier girder being reformed or bent while absorbing energy from the colliding vehicle, characterized in that the crash barrier girder (3, 4; 28) is bent obliquely downwards towards the ground (1); that it extends along said ground at a height level to be able to be driven over by the colliding vehicle and that its longitudinal direction is kept substantially unchanged compared with the original longitudinal direction of the crash barrier (2).

12. The method as claimed in claim 11, characterized in that the end of the crash barrier girder (3, 4; 28) is held fixed in the longitudinal direction of the crash barrier (2).

13. The method as claimed in claim 11, characterized in that a tall, narrow crash barrier girder (28) is divided into an upper portion (40) and a lower portion (42) before these portions are deformed.

14. A collision safety device at an end section of a crash barrier (2), and comprising at least one crash barrier girder (3, 4; 28) or profile extending approximately along the ground at a level, a safety member (6) in the area of the end portion of the crash barrier, the safety member being disposed to be hit by a colliding vehicle, and, under the action thereof, to be displaced along the crash barrier (2), the safety member having a forming device (7) engaging with the crash barrier girder (3, 4; 28) for realising an energy-absorbing configurational change in the crash barrier girder (3, 4; 28) on the displacement of the safety member along the crash barrier, characterized in that the forming device (7) has an entry end (8) at said level of the undeformed crash barrier girder (3, 4; 28) and an exit end on a lower level lower than said level in order that the deformed crash barrier girder can be driven over by the colliding vehicle, wherein said at least one crash barrier girder is bendable by said forming device such that said at least one crash barrier continues to extend substantially longitudinally.

15. A method of preventing or reducing damage to a vehicle and injury to its passengers if the vehicle collides with an end section of a crash barrier (2), comprising the steps that a crash barrier girder or profile (3, 4; 28) included in the crash barrier is provided with a forming device (7) which, under the action of a colliding vehicle, is displaced longitudinally along the crash barrier, the crash barrier girder being downwardly bent and remaining substantially longitudinal while absorbing energy from the colliding vehicle, characterized in that the crash barrier girder (3, 4; 28) is bent obliquely downwards towards the ground (1); that it is given a height level to be able to be driven over by the colliding vehicle and that its longitudinal direction is kept substantially unchanged compared with the original longitudinal direction of the crash barrier (2).

16. A collision safety device at an end section of a crash barrier, comprising:

a safety member at an end portion of the crash barrier, the safety member being disposed to be hit by a colliding vehicle, and, under the action thereof, to be displaced along the crash barrier, the safety member having a lower and upper end, the lower end being substantially at ground level, the safety member further having an entry at said upper end and an exit at the lower end of the vertical dimension;

at least one crash barrier girder having a longitudinal direction and extending approximately parallel the ground at a level of the entry of the safety member, said girder further having an end portion extending into the entry; and a forming device provided within the safety member and engaging with the crash barrier girder for realising an energy-absorbing configurational change in the girder on displacement of the safety member along the crash barrier, the forming device guiding the crash barrier girder from the entry of the safety member to the exit thereof to have the girder leave the safety member substantially of ground level and without any substantial changes of its longitudinal direction.

17. A collision safety device at an end section of a crash barrier, comprising:

a safety member at an end portion of the crash barrier, the safety member being disposed to be hit by a colliding vehicle, and, under the action thereof, to be displaced along the crash barrier, the safety member having an entry at an upper portion thereof and an exit at a lower portion thereof;

at least one crash barrier girder comprising a part of the crash barrier, the girder extending approximately along the ground and at a distance thereabove for being in alignment with the entry of the safety member;

a drawing member connecting to a ground anchor an end portion of the girder facing towards the safety member; and a forming device provided within the safety member and engaging with the girder for realising energy-absorbing configurational change in the girder on displacement of the safety member along the crash barrier, the drawing member extending through the forming device to the end portion of the girder thereby preventing the girder from departing sideways from the longitudinal directions of the crash barrier and for keeping the girder, after exit from the safety member, at a level low enough to allow the colliding vehicle to pass over the girder.

18. A collision safety device at an end section of a crash barrier, comprising:

a safety member in the area of an end portion of the crash barrier, the safety member being disposed to be hit by the colliding vehicle, and, under the action thereof, to be displaced along the crash barrier, the safety member having an entry at an upper portion thereof and an exit at a lower portion thereof and substantially at ground level;

at least one crash barrier girder constituting a part of the crash barrier, the girder extending approximately horizontally and along the ground and at a distance thereabove for being in alignment with the entry of the safety member; and a forming device provided in the safety member and engaging with the girder for realising an energy-absorbing configurational change in the girder on displacement of the safety member along the crash barrier, the forming device having at the entry of the safety member means for bending the girder obliquely downwardly and at the exit of the safety member means for re-bending the girder to a substantially horizontal orientation.

* * * * *

UNITED STATES PATENT AND TRADEMARK OFFICE

CERTIFICATE OF CORRECTION

PATENT NO. : 6,719,483 B1
DATED : April 13, 2004
INVENTOR(S) : Anders Welandsson It is certified that error appears in the above-identified patent and that said Letters Patent is hereby corrected as shown below:

Column 10,
Line 56, after "second level" -- lower -- should be inserted.

Signed and Sealed this

Fourteenth Day of September, 2004

JON W. DUDAS
*Director of the United States Patent and Trademark Office*